US008245738B2

(12) United States Patent
Neumayer

(10) Patent No.: US 8,245,738 B2
(45) Date of Patent: Aug. 21, 2012

(54) FILLING DEVICE

(75) Inventor: Walter Neumayer, Wörth/Donau (DE)

(73) Assignee: Krones AG, Neutraubling (DE)

( * ) Notice: Subject to any disclaimer, the term of this patent is extended or adjusted under 35 U.S.C. 154(b) by 311 days.

(21) Appl. No.: 12/620,700

(22) Filed: Nov. 18, 2009

(65) Prior Publication Data

US 2010/0132832 A1 Jun. 3, 2010

(30) Foreign Application Priority Data

Dec. 3, 2008 (DE) ..... 10 2008 060 379

(51) Int. Cl.
*B65B 1/30* (2006.01)

(52) U.S. Cl. ..... 141/83

(58) Field of Classification Search ..... 141/83
See application file for complete search history.

(56) References Cited

U.S. PATENT DOCUMENTS 4,241,769 A * 12/1980 Wiesner ..... 141/83
5,477,896 A * 12/1995 Grifols Lucas ..... 141/83
6,073,667 A * 6/2000 Graffin ..... 141/372
6,399,901 B1 * 6/2002 Nishino et al. ..... 177/52
6,667,444 B1 * 12/2003 Armitage ..... 177/168
6,981,529 B2 * 1/2006 Fry ..... 141/67

FOREIGN PATENT DOCUMENTS

| | | | |
|---|---|---|---|
| DE | 10 2009 011 949 | B3 | 7/2010 |
| EP | 1 025 424 | A1 | 8/2000 |
| EP | 1025424 | A1 | 8/2000 |
| WO | WO-00/47960 | A1 | 8/2000 |

OTHER PUBLICATIONS

European Search Report for Application No. EP09177221, dated Oct. 15, 2010.

* cited by examiner

*Primary Examiner* — Gregory Huson
*Assistant Examiner* — Jason K Niesz
(74) *Attorney, Agent, or Firm* — Marshall, Gerstein & Borun LLP

(57) ABSTRACT

A filling device for containers, particularly for beverage bottles, having a filling valve, a holder for the container in suspended arrangement, as well as a weighing device. To make the weighing device robust and the measurement more precise, the weighing device is assigned to the holder in close vicinity.

8 Claims, 2 Drawing Sheets

FILLING DEVICE

CROSS-REFERENCE TO RELATED APPLICATION

The present application claims the benefit of priority of German Patent Application No. 10 2008 060 379.1, filed Dec. 3, 2008. The entire text of the priority application is incorporated herein by reference in its entirety.

FIELD OF THE DISCLOSURE

The present disclosure relates to a filling device for containers, particularly for beverage containers.

BACKGROUND

Such a filling device is known from EP 1 025 424. The known filling device contains one of the standard filler carousels that extend around a substantially vertical axis and are provided on their outer circumference with radially projecting holders for the containers. The holders are normally configured in the form of tongs, the two tong jaws being spring-loaded or magnetically attracted to each other and comprising a recess adapted to the container, with which jaws the holder grips around the container for filling purposes. Normally, bottles are filled that are provided underneath the filling opening, on their neck, with a protruding flange which offers a support on the upper side of the holder. For the filling operation a filling valve is provided that is in coaxial alignment with the filling opening of the container with its outlet in the filling position. A predetermined quantity of the product is filled into the container by operating the filling valve. To control the filled state, the container is weighed. For this purpose a weighing device is provided that contains an elastically deformable element in the form of an elastic bar which is rigidly secured to the frame and the deformation of which, caused by the weight of the container, is detected and evaluated as a measure of the weight. The elastic element is acted upon by the holder, the elastic element and the holder being positioned side by side in radial direction with respect to the rotational axis of the filler carousel. The holder serves as a lever arm for acting on the elastically deformable bar. Due to this horizontally and radially extending arrangement the known weighing device is, however, relatively sensitive to vibrations caused by the operation, which arise due to the rotation of the filler carousel or due to forces, or the like, acting on the container for a short period of time. These vibrations may distort the weighing result.

SUMMARY OF THE DISCLOSURE

It is the object of the present disclosure to provide a filling device comprising a robust and reliable weighing device.

Due to the nearby arrangement of the weighing device the impact of vibrations acting on the weighing device is eliminated, or vibrations cannot build up for lack of leverage.

A particularly preferred arrangement of the weighing device is provided above, namely substantially vertically above, the holder, whereby a connection substantially protected against vibrations in the direction of gravity is possible between the container and the weighing device.

Expediently, the holder is directly connected to the weighing device via at least one substantially vertically extending arm.

An even better protection against undesired vibrations is offered by a weighing device arranged substantially in symmetry with the filling axis, the weighing device being provided on at least two opposite sides of the filling axis, the filling axis, however, preferably extending through an opening in the weighing device. This can be achieved in a constructionally simple way in that the weighing device extends around the outlet of the filling valve.

Such a design of the weighing device can be achieved in a constructionally particularly simple and reliable way by means of an elastic element the deformation of which, caused by the weight of the container, is detected. Such an elastically deformable element can be configured without difficulty to be closed in the form of a ring around the filling axis and/or the filling valve.

BRIEF DESCRIPTION OF THE DRAWINGS

An embodiment of the present disclosure will now be explained in more detail with reference to the drawings, in which.

DETAILED DESCRIPTION OF THE PREFERRED EMBODIMENT

Figure 1:
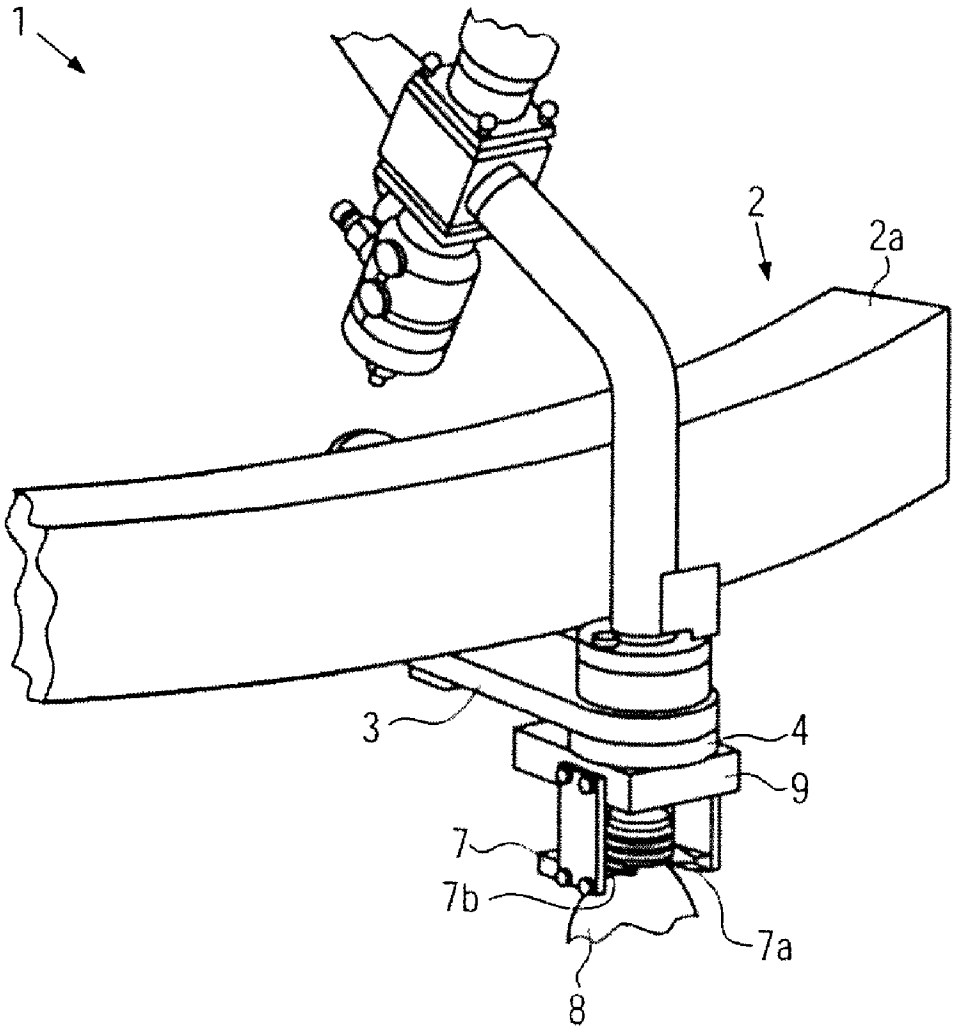
FIG. 1 is a perspective illustration showing part of a filling device configured according to the disclosure.

FIG. 1 shows a filling device 1 as part of a filling system for filling drinks, which device is e.g. a conventional filler carousel and includes a frame 2 rotatingly driven about a substantially vertical axis of rotation 2' in rotational direction D. In the illustrated embodiment only part of an outer hoop-like support member 2*a*, which extends about the rotational axis 2', can be seen of frame 2.

A support 3 which extends in radial direction with respect to the axis of rotation 2' beyond the support member 2*a* is fastened to the support member 2*a*. Said support 3 is configured as a valve accommodating means for a filling valve 4. The filling valve 4 is of a standard type and is connected via a supply line 4 and via a conventional distributor 6 to a source for product to be filled, particularly a beverage. The filling valve 4 is arranged such that its outlet is arranged in the form of a filling nozzle 4 with a substantially vertical center line 6' and a substantially horizontally extending outlet opening 6*a*.

A holder 7 for containers 8 to be filled, shown are bottles with a handling flange 8*a* provided on the neck and a container centerline 8', is arranged vertically underneath the outlet opening 6*a*.

The holder 7 includes the lateral jaws 7*a* and 7*b*, respectively, configured in the conventional way as tongs, which comprise an accommodating opening adapted to the container and an upper support area for the handling flange 8*a* and are loaded in their closing position via a spring (not shown). The resilient or magnetic force is of such a kind that the jaws 7*a*, 7*b* will move apart from each other when a container 8 presses in radial direction inwards against the jaws, and they will again move towards each other in the closing position as soon as the container 8 has reached the recess of the jaws. As a result the jaws move underneath the handling flange 8*a* and retain the container 8 for filling purposes in suspended fashion in a substantially axial orientation of the container axis 8' relative to the filling axis 6'.

In the illustrated embodiment the jaws 7*a*, 7*b* of the holder 7 are not directly secured to the frame 2, but are fastened to a weighing device 9. The weighing device may have any structure that is able to detect a weight freely suspended from said device. Preferably, the weighing unit comprises an elastically deformable element the deformation of which can be detected by measuring devices, such as e.g. strain gauges or the like. Such elastic elements are known in the case of weighing devices and need not be explained any more.

Figure 2:
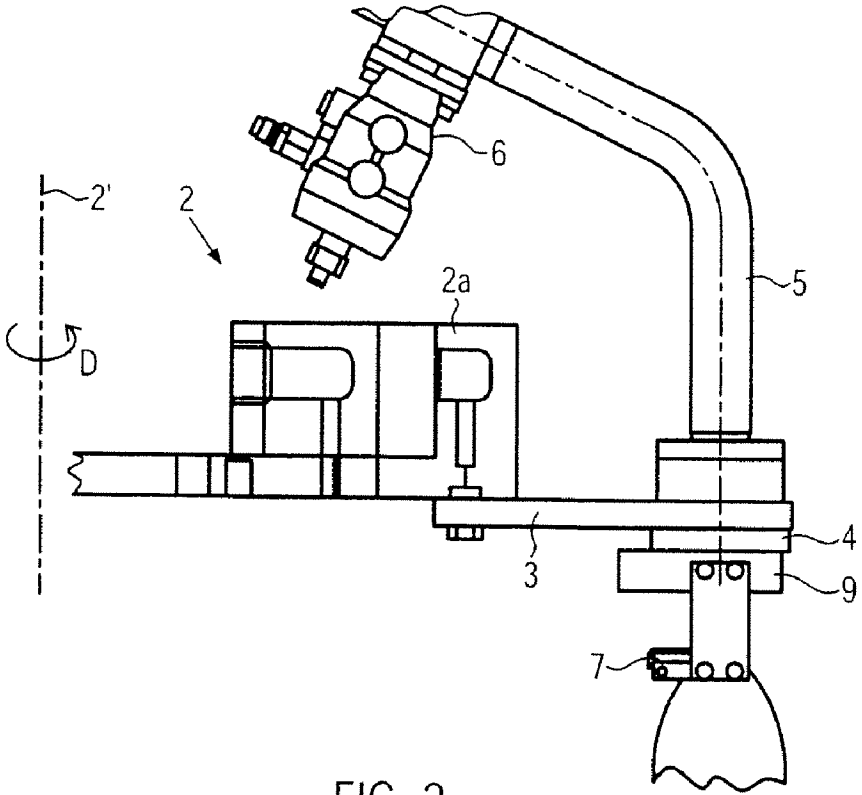
FIG. 2 is a side view of the filling device according to FIG. 1.
Figure 3:
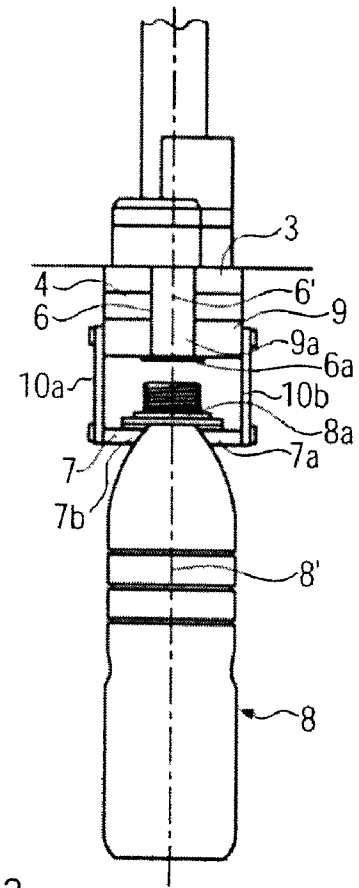
FIG. 3 is a front view of the filling device according to FIGS. 1 and 2.

The weighing device 9 is arranged in the illustrated embodiment underneath the filling valve 4 on at least two opposite sides of the filling axis 6' in such a way that the container 8 can be filled straight through the weighing device 9. Preferably, the weighing device 9 extends in a closed circle around the filling axis 6', and it is here evident that the filling nozzle 6 could be guided through an opening 9*a* in the weighing device 9. The outer shape of the weighing device 9, however, can be asymmetrical with respect to the filling axis and can e.g. be at a right angle, as becomes apparent from FIGS. 1 and 2.

The holder 7 is suspended from the weighing device via at least one, preferably two, substantially vertically extending arms 10*a*, 10*b*. The arm or arms 10*a*, 10*b* represent the sole mounting of the holder 7 and thus of the container 8 on the frame 2. The arms 10*a*, 10*b* act in symmetry with respect to the filling axis 6' and at the same distance from the filling axis 6' on the weighing device 9', the distance from the filling axis 6' being kept so small as is permitted by the neck diameter of the container 8 so as to minimize or avoid any leverage. The arms 10*a*, 10*b* are positioned at the side of the weighing device 9 which is advancing or trailing, respectively, in rotational direction. The mounting points of the arms 10*a*, 10*b* on the holder 7 on the one hand and the weighing device 9 on the other hand have the same distance from one another in rotational direction D and are arranged in symmetry with respect to the filling axis 6' so that the arms 10*a*, 10*b* can extend optimally in vertical direction.

The weighing device 9 and the holder 7 are configured such that the two can be arranged nearby or in close vicinity relative to each other, i.e. as closely adjacent as possible, to avoid any long leverage. To be more specific, the holder 7 and the weighing device 9 are spaced apart from each other at a distance just sufficient to accommodate the container 8 above the handling flange 8*a* between the holder and the outlet opening 6*a*, the outlet opening 6*a* preferably ending with the lower boundary of the weighing device 9. Thus the arms 10*a*, 10*b* extend exactly vertically.

In a modification of the described and illustrated embodiments the weighing device may optionally also be arranged above the filling valve or at another place along the filling axis 6'. The arms for the suspension of the holder may also extend (slightly) obliquely with a correspondingly stiff configuration. Preferably, the weighing device contains an elastically deformable material, the deformation of which is picked up in a known way, for example through the strain gauge, and is transmitted to a control and/or display device for evaluation. Other constructional configurations of a weighing device, of which many are available on the market, are also possible.

The invention claimed is:

1. A filling device for containers, particularly for beverage bottles, comprising a filling valve, a holder for a container in suspended arrangement, the container having a portion including a handling flange, and a weighing device which is assigned to the holder in close vicinity and extends around the outlet of the filling valve and where more than one of said filling devices are mounted on a filler carousel, wherein the holder and the weighing device are spaced apart from each other at a distance just sufficient to accommodate the container above the portion of the container including the handling flange between the holder and the outlet opening, the outlet opening ending with the lower boundary of the weighing device.

2. The filling device according to claim 1, wherein the weighing device is arranged substantially vertically above the container which is positioned in the holder.

3. The filling device according to claim 1, wherein the holder is connected to the weighing device through at least one substantially vertically extending arm.

4. The filling device according to claim 1, wherein the weighing device is arranged on at least two opposite sides and in symmetry with the filling axis.

5. The filling device according to claim 2, wherein the container is filled straight through the weighing device.

6. The filling device according to claim 1, and an outlet of the filling valve extends through the weighing device.

7. The filling device according to claim 1, wherein the weighing device contains an element which is elastically deformable by the weight of the container.

8. The filling device according to claim 7, wherein, the elastically deformable element is closed in the form of a ring and comprises an opening for the filling operation.

* * * * *